US007546713B2

(12) United States Patent
Bradley

(10) Patent No.: US 7,546,713 B2
(45) Date of Patent: Jun. 16, 2009

(54) SWIMMING POOL COPING SUPPORT EXTENDER

(76) Inventor: David A. Bradley, 250 Route 61 South, Schuylkill Haven, PA (US) 17972

( * ) Notice: Subject to any disclaimer, the term of this patent is extended or adjusted under 35 U.S.C. 154(b) by 631 days.

(21) Appl. No.: 11/136,217

(22) Filed: May 24, 2005

(65) Prior Publication Data

US 2005/0262780 A1 Dec. 1, 2005

Related U.S. Application Data

(60) Provisional application No. 60/574,314, filed on May 25, 2004.

(51) Int. Cl.
*E04G 11/04* (2006.01)

(52) U.S. Cl. ..... 52/246; 52/247; 52/102; 52/245

(58) Field of Classification Search ..... 52/102, 52/245, 246, 481, 86; 47/22
See application file for complete search history.

(56) References Cited

U.S. PATENT DOCUMENTS 3,974,605 A * 8/1976 Beatty et al. ..... 52/481.1
4,232,491 A * 11/1980 Bumgarner, Sr. ..... 52/169.7
4,781,000 A 11/1988 Bertsch et al. ..... 52/169.8
5,018,324 A 5/1991 Lankheet ..... 52/169.7
5,025,601 A 6/1991 Hand ..... 52/169.7
6,094,877 A * 8/2000 White ..... 52/247

* cited by examiner

*Primary Examiner*—Richard E Chilcot, Jr.
*Assistant Examiner*—Alp Akbasli
(74) *Attorney, Agent, or Firm*—Drinker Biddle & Reath LLP; John J. Marshall

(57) ABSTRACT

For use with prefabricated pool wall panels that have a top flange extending outwardly from the pool cavity to attach a coping layer, an extender strip attachable to the top flange increases the effective width of coping support. The extender strips have a curvature conforming to the curvature of the wall panel. The extender strip includes a flat portion for supporting a coping layer and a flange portion adjacent the outside perimeter of the strip. The strip can be attached to the wall panel with the flange portion facing up or down, depending on the nature of the coping layer. The structure may also include horizontal support brackets and vertical support braces.

4 Claims, 4 Drawing Sheets

SWIMMING POOL COPING SUPPORT EXTENDER

CROSS-REFERENCE TO RELATED APPLICATIONS

This application claims priority of U.S. Provisional Application No. 60/574,314, filed May 25, 2004, entitled "Swimming Pool Coping Support".

FIELD OF THE INVENTION

The field of this invention is swimming pools constructed from pre-fabricated wall panels. The invention provides structure for selectively adding a flat platform extending outward from the top of one or more wall panels to support an extended coping layer, such as an apron formed of decorative stone pavers.

BACKGROUND OF THE INVENTION

Modular swimming pool construction using pre-formed wall panels is well known, and there are a wide variety of such panels. The wall panels can be straight or curved depending on the wall segment and the shape of the pool, and generally have some sort of brace structure embedded in the ground outside of the wall panels and a top flange extending horizontally outward from the top of the panel. The top flange is useful to mount a hanger for the pool liner and provides an attachment surface for coverings to hide the top of the panel. These coverings are frequently referred to by the inclusive term "coping", derived from the same term for the top course of a stone wall, which was usually slanted slightly to run off rainwater. In the field of swimming pool construction, however, a coping can be resilient plastic or vinyl coverings, concrete aprons, decorative tile, brick, stone or other decorative structure.

When a heavy material such as concrete or stone is used to provide a wide coping, there is some risk of cracks appearing over time due to settling of the backfill around the pool. In a typical installation, after the wall panels are connected and leveled, a concrete footer is poured around the base of the walls and the bottom segments of the panel brace structure. Then the excavated pit is backfilled outside the walls to a level at or above the top of the wall. Then a shallow trench is excavated in the backfill and a form of some sort is placed in the trench in order to pour a concrete coping layer or the base for stone pavers. One side of the form is usually attached to and overlies the top flange of the wall panel, but the bulk of the form is supported only by the backfill. If the backfill settles, the coping layer is cantilevered to the wall panel and can easily crack.

There have been many panels and brace assemblies designed to alleviate the problem of supporting heavy coping and/or attached decks. Some employ hollow upright tubes attached to the brace structure and extending upward to behind the wall panel, so that pouring a concrete surface layer simultaneously fills the tubes and creates structural support columns beneath. Examples of this design are shown in U.S. Pat. Nos. 4,232,491; 4,781,000; and 5,025,601. Another design shown in U.S. Pat. No. 5,018,324 uses swing out deck support brackets with pivot mounts on bolts in the wall panels.

These designs may provide support for a wide concrete coping or apron, but they add cost and complexity to the wall assembly. In addition, the structure to attach the tubes and pivot mounts remains on the wall panel structure whether they are used or not. It would be useful to have instead a standard, simple wall panel and provide with it easily attachable structure for selectively adding a support extension outward from the top of the panel. This invention provides that capability.

BRIEF SUMMARY OF THE INVENTION

The invention is in an extender strip that can be attached to the top flange of a swimming pool the wall panel to increase the effective width of support for a coping layer, and to a wall panel with the extender attached. The extender strip has a curvature conforming to the curvature of the wall panel. The extender strip includes a flat portion for supporting a coping layer and a flange portion adjacent the outside perimeter of the strip. The strip can be attached to the wall panel with the flange portion facing up or down, depending on the nature of the coping layer. The structure may also include horizontal support brackets and vertical support braces.

DESCRIPTION OF THE INVENTION

Figure 1:
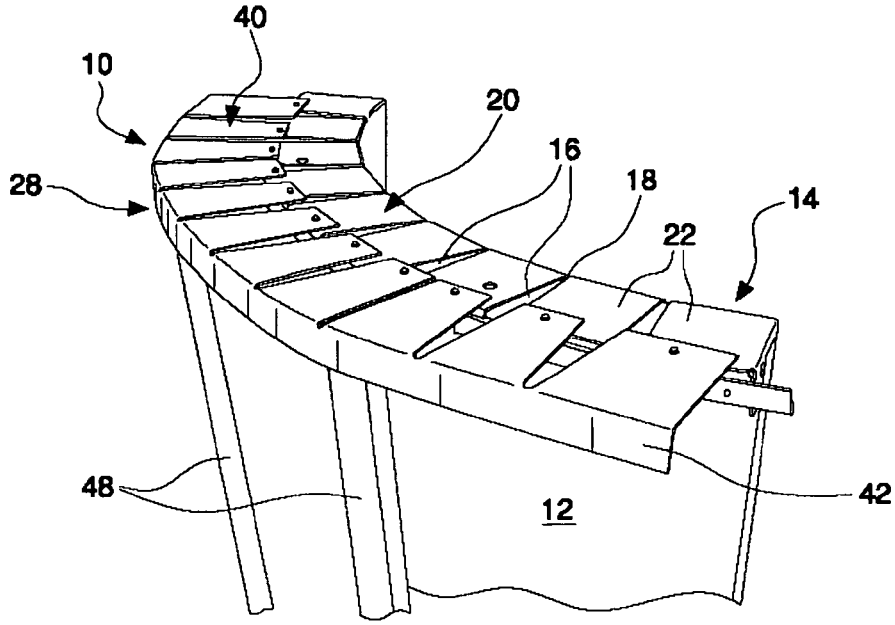
FIG. 1 is a perspective view of an upper portion of a curved swimming pool wall panel having attached to it a coping support extender according to an embodiment of the present invention.

FIG. 1 shows a coping support extender (10) according to an embodiment of the present invention attached to an upper portion of a curved swimming pool wall panel (12). The wall panel is of a type that has a top flange (14) extending horizontally outward from the pool cavity. Wall panels of this type are generally fabricated from galvanized steel sheet. The top flange (14) is formed by punching out notches (16) corresponding to the depth of the flange before the steel sheet is formed into its curved shape. This allows the flange (14) to be formed by bending the notched area outward from the bend radius (18) at the bottom point of the notches. The notches spread with the bending to make a relatively flat top surface (20) composed of adjacent tabs (22).

Figure 2:
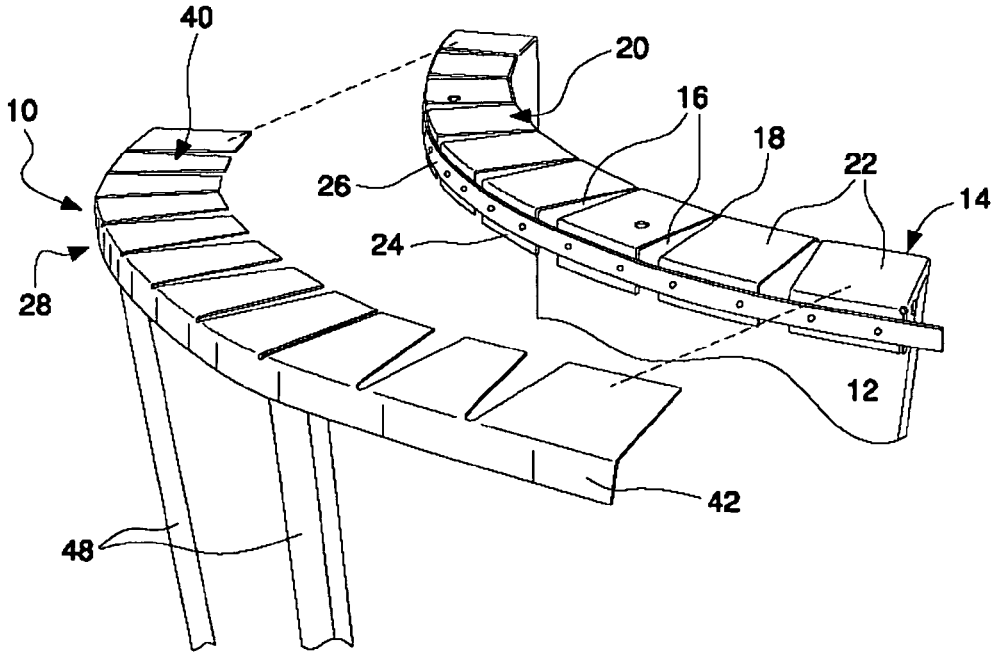
FIG. 2 is an exploded view from a similar perspective as in FIG. 1 showing the coping support extender detached from and in proximate relation to the swimming pool wall panel.

FIG. 2 is shows the same panel (12) with the extender (10) detached and moved away. It shows that the distal ends of the tabs (24) are bent downward perpendicular to the top flange surface. A circumferential steel band (26) is then fixed to the down-turned tab ends to reinforce the circumference of flange and resist deformation of the tabs.

Both FIGS. 1 and 2 show components of an extender (10) for increasing the effective width of support for a coping layer. The additional support surface is an extender strip (28) having a curvature conforming to the curvature of the wall panel; that is, the arc of the extender strip and the arc of the extender are essentially concentric. An extender strip is preferably made with the same arc segment as the curved wall panel (or in the same length as a straight wall panel), since it can be easily cut into smaller sections if needed.

Figure 3:
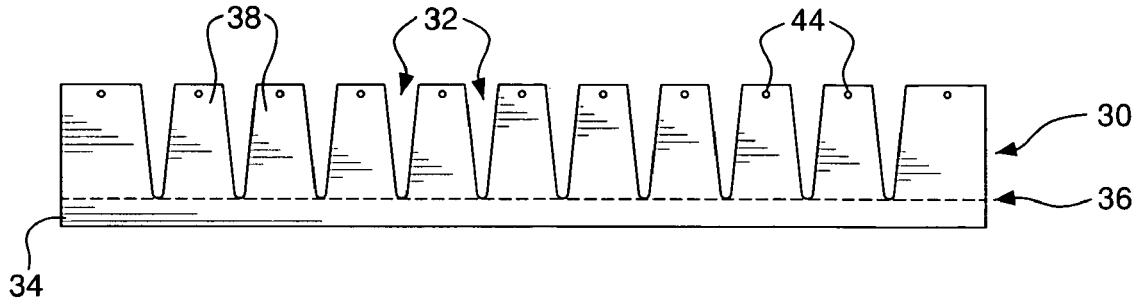
FIG. 3 is top plan view of a flat strip of galvanized steel drilled and stamped with screw holes and curvature notches, but before it is bent at the seam to a right angle to form an extender strip.

While the extender strip (28) for a straight wall panel can have a flat continuous surface, a curved extender strip is preferably made by stamping a flat steel sheet (30) as shown in FIG. 3 to form notches (32) in the sheet and a short solid band (34) below the notches. The sheet is then bent perpendicularly at the seam (36) between the notched area and solid band. This sheet can then be bent into the proper curvature at the installation site as it is being attached to the wall panel. The adjacent flat tabs (38) formed by the notches provide a relatively flat surface (40) for supporting the coping layer. The solid band forms a flange (42) adjacent the outside perimeter of the extender strip at essentially a right angle to the flat surface (40). The steel sheet (30) may also be stamped or drilled with small holes (44) to facilitate fixing the extender strip (28) to the wall panel with self tapping screws.

Figure 4:
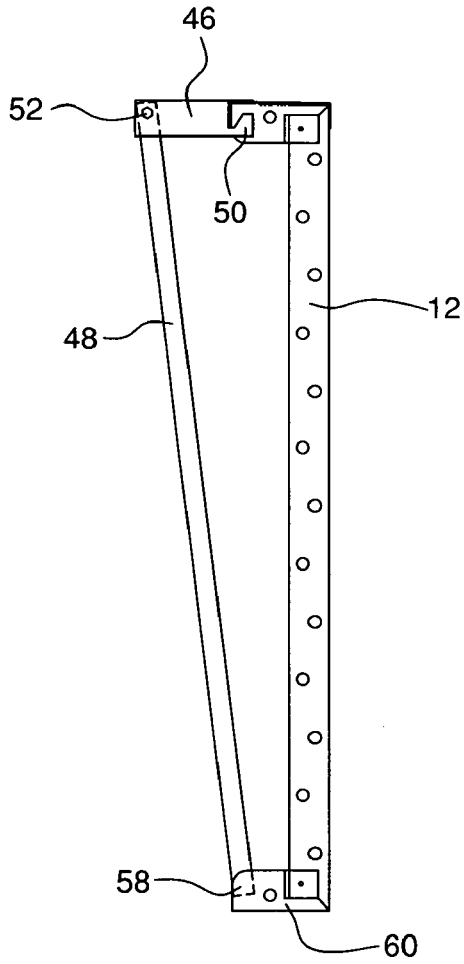
FIG. 4 is a side plan view of a section of a wall panel having attached to it a coping support extender according to an embodiment of the present invention.

Underlying the extender strip (28) are horizontal support brackets (46) located at spaced intervals, which are attachable at one end to the wall panel (12) and at the other end to a support brace (48), as shown in FIG. 4. Preferably, the horizontal support bracket (46) is an open "C" channel bar with a hook slot (50) at one end and holes (52) for a through bolt at the other. The horizontal bracket is easily formed by stamping a short rectangle of steel sheet with two holes at one end and two hook slots in the other. The sheet is then bent into an open C section to align the holes and the slots.

Figure 5:
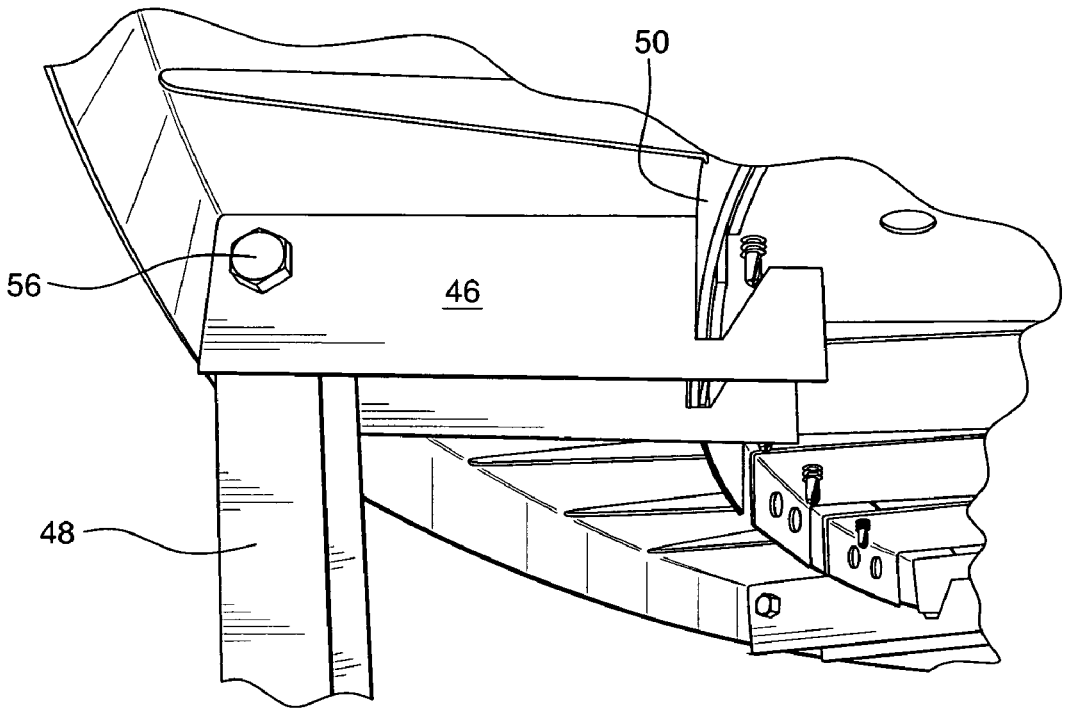
FIG. 5 is a perspective view from below of a section of the coping support extender strip showing the detail of the horizontal support bracket.

FIG. 5 shows how the brackets (46) are easily connected to the wall panel by placing the hook slots under the band (26) and distal ends of the wall panel tabs. At the other end of the horizontal bracket a support brace (48) is attached by passing a bolt (56) through the bolt holes (52) in the bracket and the corresponding holes in the bar. The other end (58) of the support brace is attached to the base (60) of the panel support framework, as shown in FIG. 5, to provide upright support at the outer perimeter of the extender strip. After adjustment of the support braces, the extender strip can be fixed to the wall panel by driving screws through the tabs (38) of the extender strip into the tabs (24) of the wall panel flange.

Figure 6:
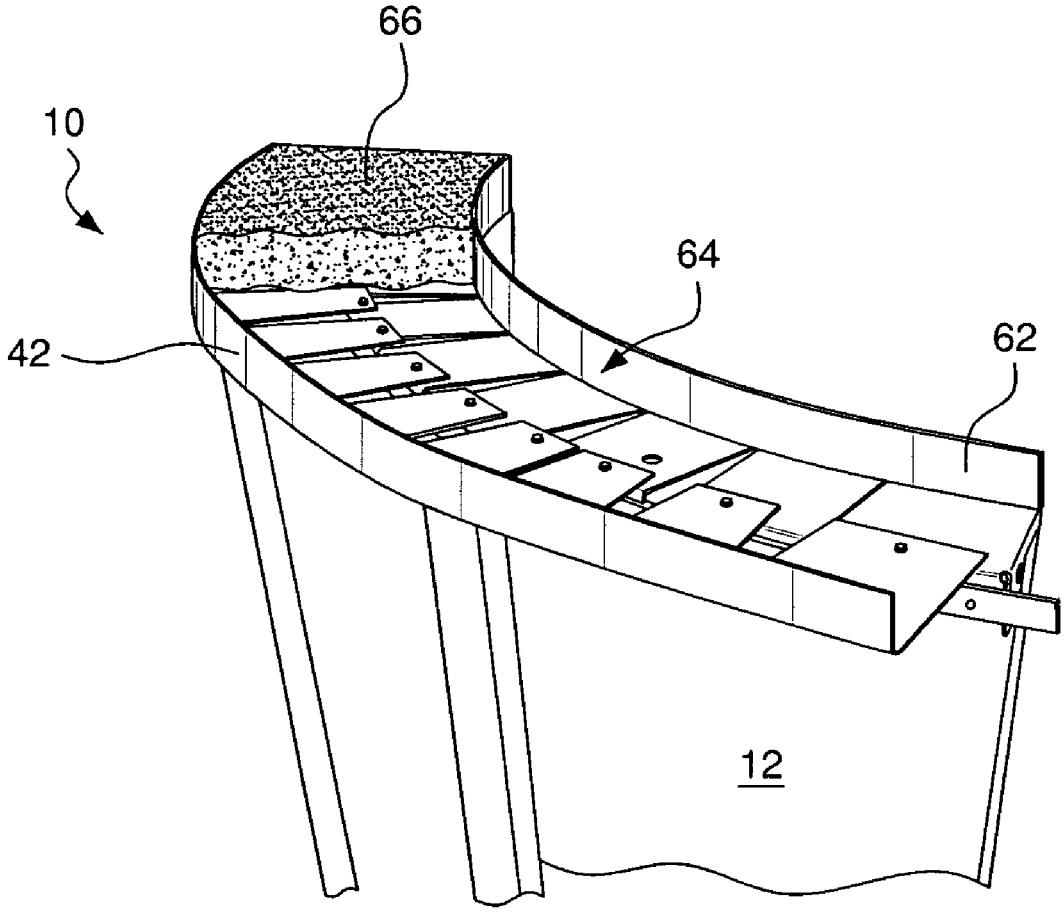
FIG. 6 is a perspective view of an upper portion of a swimming pool wall panel with a coping support extender attached to it with the flange facing upward and a high profile liner hanger attached to create a form for a poured concrete coping layer.

The extender strip (28) can be installed with its flange (42) extending either up or down. FIG. 1 shows an installation with the flange facing downward. FIG. 6 shows an insulation with the flange (42) facing upward. In installations where the extender strip is installed with the outer band flange 26 extending upward, a relatively high profile liner hanger bracket (62) can be attached along the inside edge of the wall panel's top flange to create a concrete pour form (64) between the bracket and outer band. A section of concrete coping layer (66) is shown in the form. The coping layer can stand alone or provide a base in which to set decorative stone pavers. In installations where the extender strip is installed with the outer band flange extending downward, a relatively low profile liner hanger bracket can be is attached along the inside edge of the wall panel's top flange to create a relatively flat surface between the bracket and outer band. This flat surface can be covered with a construction adhesive to attach a molded plastic or vinyl coping or for direct application of paver blocks (not shown).

The extender (10) may be installed prior to backfilling the pit outside of the pool walls. The notches in the top wall flange and in the extender strip allow fill material to be tamped down from the top to compact the fill under the extender.

The above description is of present embodiments of the invention, but the claims which follow may be broader in scope than these embodiments.

I claim:

1. A pool wall panel fabricated from galvanized steel sheet in which the wall panel has a top flange extending horizontally outward from the pool cavity, wherein the top flange is formed by punching out notches in a notched area of the sheet and bending the notched area outward at a bottom point of the notches to form a relatively flat surface composed of adjacent tabs, further comprising:

(a) an extender strip attached to an outward portion of the tabs to increase the effective width of support for a coping layer;

(b) a plurality of horizontal support brackets adapted to underlay and support the extender strip, the brackets being attachable at one end to the wall panel and at the other end to a support brace; and (c) a plurality of support braces having one end adapted for attachment to a horizontal support bracket and another end adapted for attachment to a support structure for the wall panel.

2. A wall panel as in claim 1, wherein the wall panel has a curvature and the extender strip has a curvature conforming to the curvature of the wall panel.

3. A wall panel as in claim 2, further comprising the extender strip having a flat portion connected to the wall flange and a flange portion extending in substantially a right angle to the flat portion.

4. A wall panel as in claim 3, wherein the flat portion of the extender strip includes a plurality of spaced notches.

* * * * *